United States Patent [19]

Shimizu et al.

[11] 3,988,083

[45] Oct. 26, 1976

[54] NON-CONTACT VANE PUMP

[75] Inventors: Kenji Shimizu, Ikeda; Junzo Nakaishi, Kawanishi; Kazuya Yamamoto, Ikeda, all of Japan

[73] Assignee: Daihatsu Kogyo Company Limited, Osaka, Japan

[22] Filed: Jan. 30, 1975

[21] Appl. No.: 545,398

Related U.S. Application Data

[63] Continuation of Ser. No. 282,036, Aug. 21, 1972, abandoned.

[30] Foreign Application Priority Data

| | | |
|---|---|---|
| Aug. 28, 1971 | Japan | 46-66102 |
| July 20, 1972 | Japan | 47-73266 |
| July 20, 1972 | Japan | 47-73267 |
| July 20, 1972 | Japan | 47-73278 |

[52] U.S. Cl. ..... 418/264

[51] Int. Cl.[2] ..... F04C 17/00

[58] Field of Search ..... 418/256, 260, 264

[56] References Cited

UNITED STATES PATENTS

| | | | |
|---|---|---|---|
| 1,492,456 | 4/1924 | Hansen-Ellehammer | 418/260 |
| 2,636,480 | 4/1963 | Becker | 418/260 |
| 3,578,889 | 5/1971 | Dagne | 418/256 |

FOREIGN PATENTS OR APPLICATIONS

| | | | |
|---|---|---|---|
| 492,322 | 2/1930 | Germany | 418/264 |
| 2,029,280 | 12/1971 | Germany | 418/260 |
| 434,660 | 4/1948 | Italy | 418/260 |
| 235,095 | 6/1925 | United Kingdom | 418/264 |
| 280,253 | 11/1927 | United Kingdom | 418/93 |

*Primary Examiner*—C. J. Husar
*Assistant Examiner*—Leonard Smith
*Attorney, Agent, or Firm*—Hall & Houghton

[57] ABSTRACT

The present invention relates to a non-contact type vane pump adapted to prevent the generation of heat due to direct contact between the outer edges of the rotatively driven vanes of the vane pump and the inner surface of the pump casing. The principle arrangement resides in this that the extent to which the vanes rotating under the action of centrifugal force extend radially during operation is suppressed by guide members of less frictional loss disposed in a region adjacent to the center where the peripheral speed is minimum. Non-contact type vane pumps having sub-arrangements based on said principal arrangement are also provided. Advantages and details of such arrangements will be made clear.

2 Claims, 12 Drawing Figures

NON-CONTACT VANE PUMP

This is a continuation of application Ser. No. 282,036, filed Aug. 21, 1972 now abandoned.

BACKGROUND OF THE INVENTION a. Field of the Invention

The present invention relates to a non-contact type vane pump adapted to prevent the generation of heat due to direct contact between the outer edges of the rotatively driven vanes and the inner surface of the pump casing.

b. Field of the Prior Art.

A vane pump is generally known of the constant-volume type comprising a casing having a cylindrical inner surface, an eccentric rotor disposed in the casing, and vanes fitted in substantially radial slots in the rotor in which they are guided for advancing and retracting movement.

In addition, by the term "substantially radial slot" is meant a slot extending radially in such a manner as to pass through or deviate from the center of the rotor. In this type, the driving of the rotor causes the vanes to be outwardly extended in the slots and urged against the inner surface of the casing by the action of centrifugal force, thus creating a sealing action, or cooperating with separately installed extending springs to increase such sealing action. Thus there is an advantage that the construction of the vanes and the sealing means are very simple. Particularly, the radial slots in the rotor can be dimensioned so that they are sufficiently deep and provide for a snug fit for the vanes.

Therefore, there is no need to provide a special sealing mechanism in the slot portion. The type, however, has a serious disadvantage that as the rotative speed of the rotor is increased, the wear of and the generation of heat in the vanes and the casing are increased since the vanes are pressed against the inner surface of the casing.

SUMMARY OF THE INVENTION

In view of said disadvantage of the prior art vane pump, the present invention provides improvements and has for its, principal object to prevent direct contact between the outer edges of the vanes and the inner surface of the pump casing, thereby preventing the wear of and the generation of heat in the vanes and the inner surface of the pump casing. Another object of the present invention is to provide means whereby the extent to which the vanes rotating under the action of centrifigal force extend radially during operation is suppressed by guide means of less frictional loss disposed in a region adjacent to the center where the peripheral speed is minimum, thereby minimizing the wear of and the generation of heat in the elements constituting the vane pump.

A further object of the invention is to simplify the construction of the means for suppressing the radial extension of vanes to facilitate manufacture and assembly.

In order to achieve the aforesaid objects, according to the present invention, vane means comprising at least two vanes adapted to be fitted in substantially radial slots in a rotor for advancing and retracting movement therein are each provided with shaft-like members projecting from the opposite sides of the inner edge of each vane, said shaft-like members being supported on the inner peripheral surfaces of rotatable rail members such as bearing supported in side covers on the opposite sides of a casing. The inner peripheral surfaces of said rotatable rail members are of circular form similar to and concentric with the inner peripheral surface of the casing. Thus, when the eccentric rotor eccentrically disposed in the casing is rotated, the action of causing the vanes slidably fitted in the substantially radial slots in the rotor to extend outwardly by centrifugal force is suppressed by said shaft-like projecting members supported on the inner peripheral surfaces of the rotatable rail members which are concentric with the inner peripheral surface of the casing, so that the outer edges of the vanes are prevented from directly contacting the inner peripheral surface of the casing.

In addition, the fact that the vanes are prevented from directly contacting the inner peripheral surface does not mean that the vanes are extremely short in length but that they are so dimensioned as to form a very small clearance between the outer edges of the vanes and the inner peripheral surface of the casing.

Further, the present invention provides small bearing-like rolling members mounted on shaft-like members projecting from the opposite sides of the inner edge of a vane, said rolling members being in contact with and supported by the inner peripheral surfaces of the rail members, thereby greatly reducing the wear of the members which suppress the radial extension of the vane. Thus, particularly in the case of using a plurality of vanes, the difference in peripheral speed due to the eccentric rotation of the individual vanes can be accommodated and cancelled by the rotation of the rolling members around their own respective axes.

Further, the present invention provides means whereby said rotatable rail members supporting the rolling members for a vane are positively rotated by utilizing the rotative force of the vane or rotor of the assembly of vane means and rotor, so that when a plurality of vanes are used, the rotative loads on the rolling members of the individual vanes are decreased and the wear of the individual rolling members and hence the generation of heat are almost eliminated.

Besides these, the present invention provides arrangements which facilitate the manufacture and assembly of the elements constituting a non-contact type vane pump and further improve useful life and performance.

BRIEF DESCRIPTION OF THE DRAWINGS

The accompanying drawings illustrate non-contact type vane pumps embodying the present invention.

DESCRIPTION OF THE PREFERRED EMBODIMENTS

Figure 1:
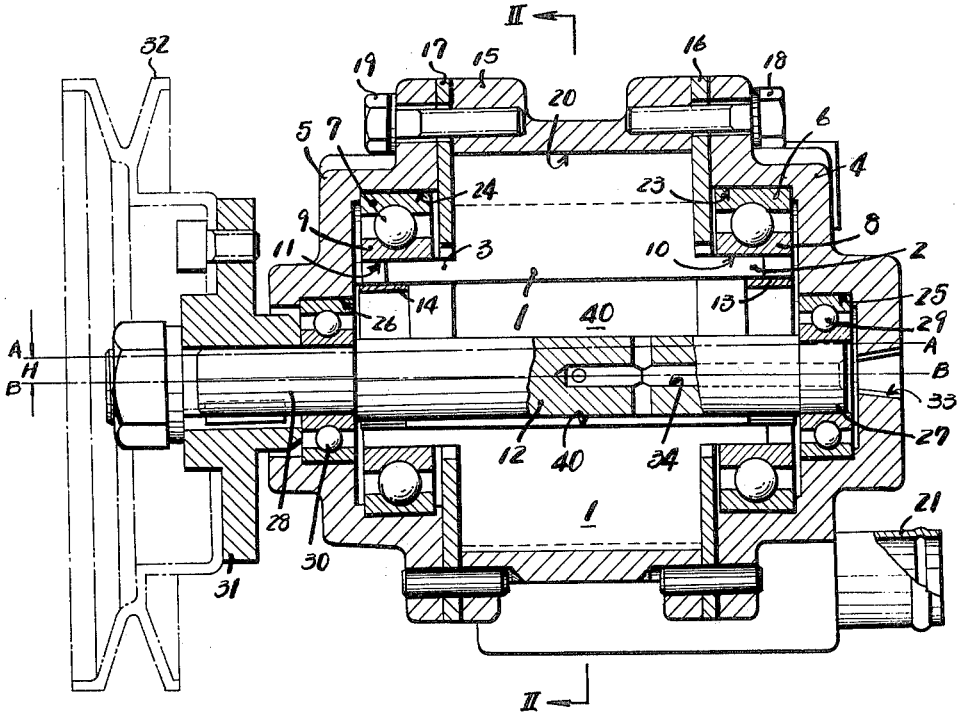
FIG. 1 is a longitudinal section of a first embodiment.
Figure 2:
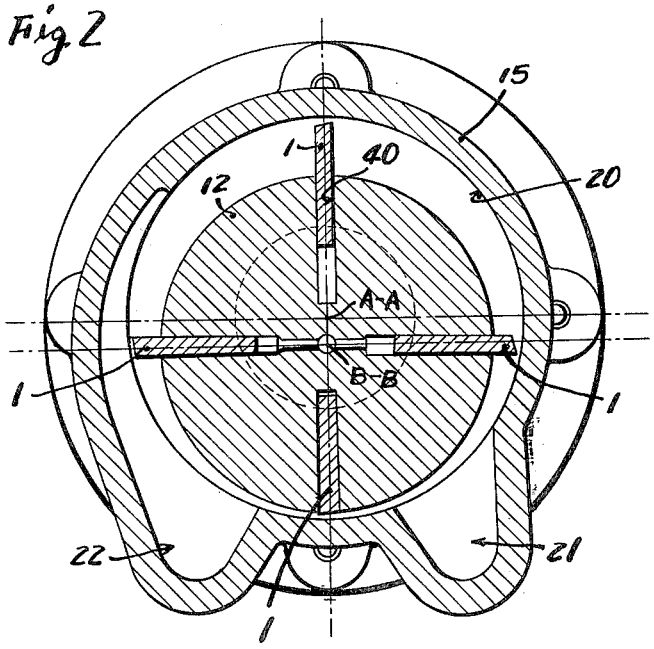
FIG. 2 is a section taken on the line II—II of FIG. 1.

Referring to FIGS. 1 and 2 showing a first embodiment of the invention, shaft-like members 2 and 3 projecting from the opposite sides of the inner edge of each vane 1 are opposed to the inner surfaces 10 and 11 of the inner races 8 and 9 of rotatable rail members, e.g. ball bearings 6 and 7 secured to side covers 4 and 5. When an eccentric rotor 12 starts to rotate and centrifugal force acts on the vanes 1, the vanes 1 slide outwardly from radial slots 40 in the rotor 12 so that the shaft-like members 2 and 3 are pressed against the inner surfaces 10 and 11 of the inner races and rotated along with the inner races 8 and 9. Cylindrical tension springs 13 and 14 are disposed inside the shaft-like members 2 and 3, so that the shaft-like members 2 and 3 are opposed to the inner surfaces 10 and 11 of the inner races with a predetermined slight clearance therebetween.

In addition, in FIG. 1, the numeral 15 designates a casing, and 16 and 17 designate side plates, and along with the side covers 4 and 5 constituting part of the casing, they are made integral by bolts 18 and 19. As shown in FIG. 2, the casing 15 is provided with a cylindrical inner surface 20 with center line at A—A, a delivery port 21 and a suction port 22, as usual. The side covers 4 and 5, as shown in FIG. 1, has annular recesses 23 and 24 with center at A—A, and annular recesses 25 and 26 with center at B—B are eccentric by an amount of H with respect to A—A. Force-fitted in the recesses 23 and 24 are the ball bearing 6 and 7 supporting the shaft-like members 2 and 3 of the vanes, while ball bearings 29 and 28 supporting the shafts 27 and 28 projecting from the opposite sides of the rotor 12 are force-fitted in the recesses 25 and 26. The numerals 31 and 32 designate a flange and a pulley, respectively, secured to the shaft 28. Further, the numerals 33 and 34 designate lubricating oil feed passageways.

According to the first embodiment of the invention described above, inspite of the fact that the vanes 1 and the rotor 12 can be substantially the same construction as in the prior art, it is possible to obtain a construction in which the vanes 1 do not at all contact the cylindrical inner surface 20 of the casing 15. Particularly, since it is so constructed that the shaft-like members 2 and 3 are pressed against the inner surfaces 10 and 11 of the inner races 8 and 9 of ball bearings and rotated along with them, there is an advantage that the friction therebetween is very small, utilizing the characteristics of the smoothly operable ball bearings 6 and 7 to the full.

Further, if the cylindrical inner surface 20 is pre-finished to a shape suited to the path of the outer ends of the vanes 1, it is possible to increase the pump efficiency.

In addition, in embodying the present invention, the use of needle roller bearings having inner races instead of said ball bearings 6 and 7 will be effective to decrease the size of the apparatus.

Figure 3:
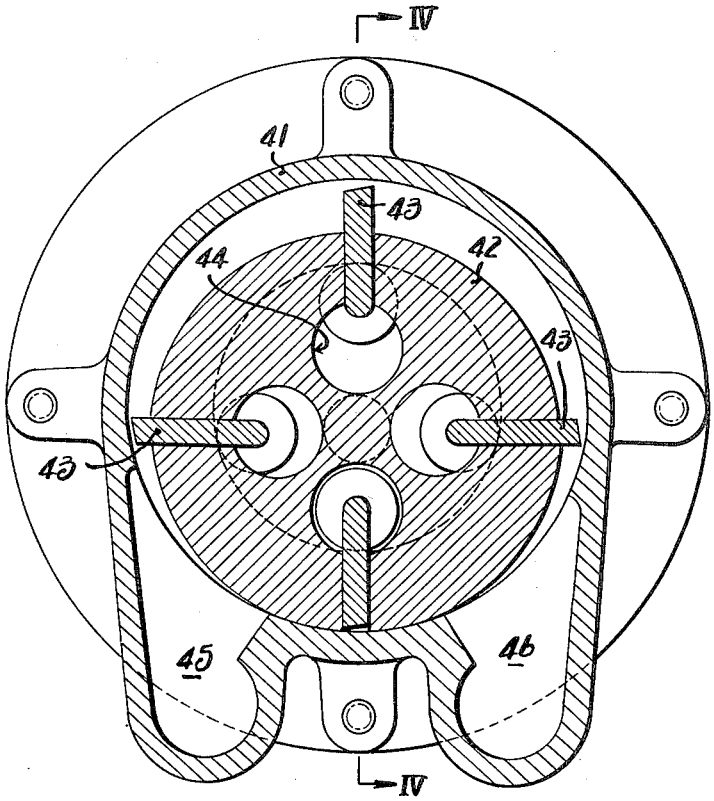
FIG. 3 is a longitudinal section of a second embodiment.

In FIG. 3, showing a second embodiment of the invention, the numeral 41 designates a pump casing; 42, a rotor eccentrically disposed in the casing; 43, a vane loosely fitted in a radial slot 44 in the rotor; 45, a suction port; and the numeral 46 designates a delivery port.

Figure 4:
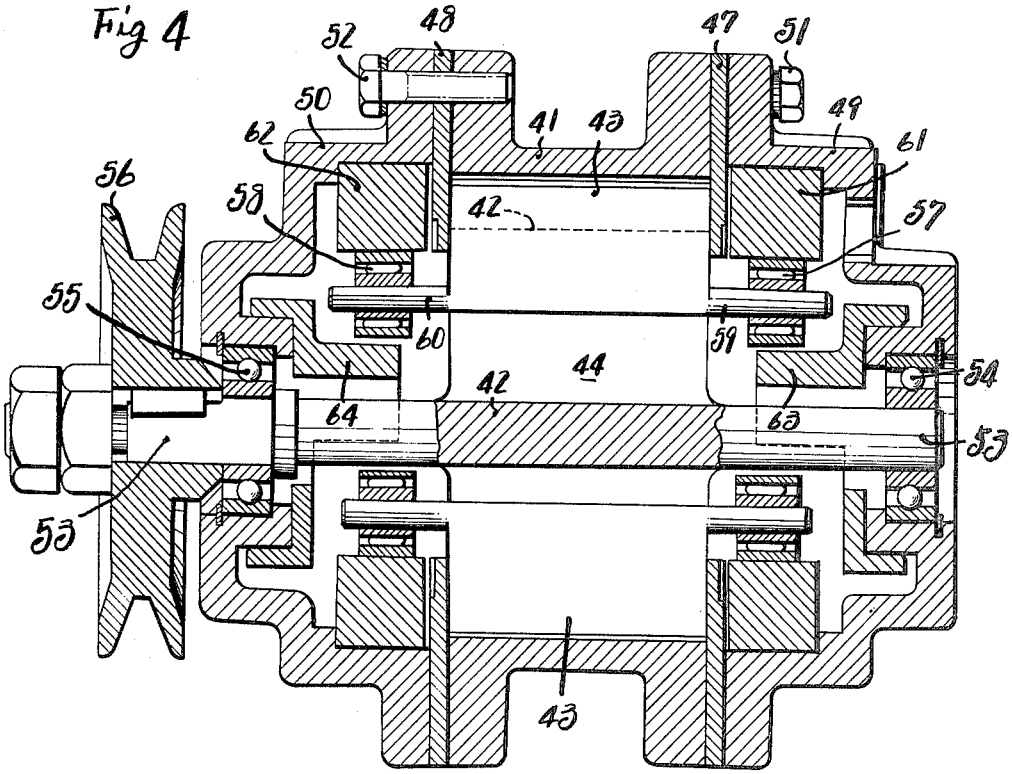
FIG. 4 is a section taken on the line IV—IV of FIG. 3.

The casing 41, as shown in FIG. 4, is cylindrical and has side covers 49 and 50 secured to the opposite open sides by bolts 51 and 52 thereof with side plates 47 and 48 interposed therebetween.

The rotor 42, as shown in FIG. 4, has a shaft 53 integral therewith rotatably mounted in bearings 54 and 55 in the side covers 49 and 50. Therefore, said rotor 42 will rotate in an eccentric position in the casing 41. The shaft 53 of the rotor 42 has a driving pulley 56 fixed to one end thereof.

As shown in FIG. 4, the vanes 43 loosely fitted in the radial slots 44 in the rotor 42 have rolling members 57 and 58 on the opposite sides of the inner edge thereof. The rolling members 57 and 58 are constituted as by microbearings and mounted on shaft portions 59 and 60 projecting from the vanes 43. Annular rail members 61 and 62 associated with said rolling members 57 and 58 are fixed to the side covers 49 and 50.

The annular rail members 61 and 62 have inner surfaces of circular form concentric with and similar to the inner surface of the casing 41 and can be made integral with the side covers 49 and 50.

In addition, in FIG. 4, the numerals 63 and 64 designate auxiliary guide members which prevent the vanes 43 from falling down during stoppage of the pump and which, during operation of the pump, will be in non-interferring relation to the rolling members 57 and 58 of the vanes 43.

The operation of the pump is effected by rotating the rotor 42 through the driving pulley 56.

Upon rotation of the rotor 12, the vanes 41 extend outwardly in the interior of the casing by the action of centrifugal force. In this case, since the rolling members 57 and 58 are in rolling contact with the inner surfaces of the annular rail members 61 and 62 of the side covers 49 and 50 to execute planetary motion while rotating around their own axes, the further outward extension of the outer edges of the vanes 42 suppressed, providing a slight clearance between said outer edges and the inner surface of the casing 41, thus assuring non-contact rotation of the vanes 43. Further, since the rolling members 57 and 58 are in rolling contact with the annular rail members 61 and 62, wear and the generation of heat can be decreased to a minimum.

Particularly in the case where a plurality of vanes 43 are used, since the rolling members 57 and 58 of the vanes 43 are individually in rolling contact with the annular rail members 61 and 62, the differences between the peripheral speeds of the individual rolling members 57 and 58 rotating in eccentric condition are accommodated by their rotation around their own axes and do not matter at all.

Since the second embodiment of the invention is as described above, it is possible to minimize the wear of and the generation of heat in the elements constituting the vane pump and improve the performance and useful life.

Figure 5:
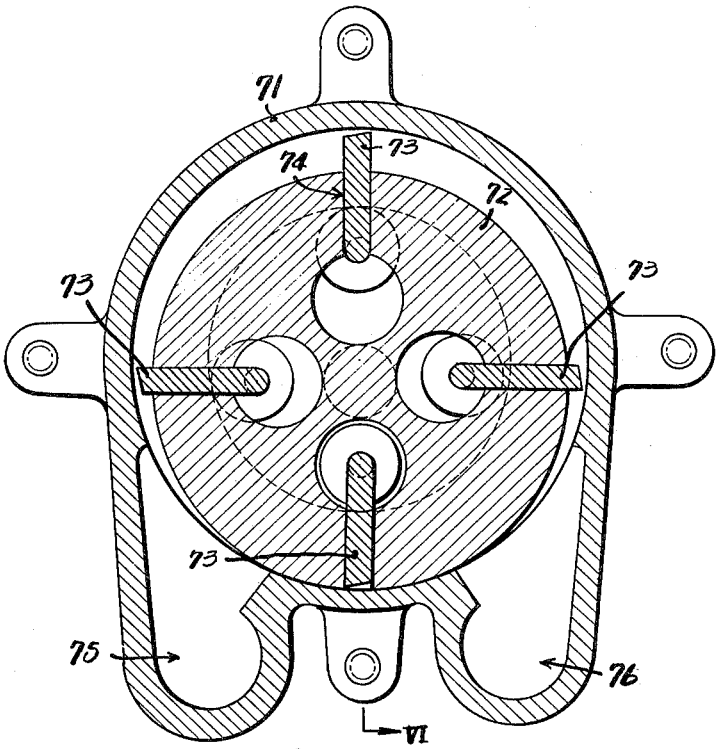
FIG. 5 is a longitudinal section of a third embodiment.

In FIG. 5 showing a third embodiment of the invention, the numeral 71 designates a pump casing; 72, a rotor eccentrically installed in the casing; 73, a vane loosely fitted in a radial slot 74 in the rotor; 75, a suction port; and the numeral 76 designates a delivery port.

Figure 6:
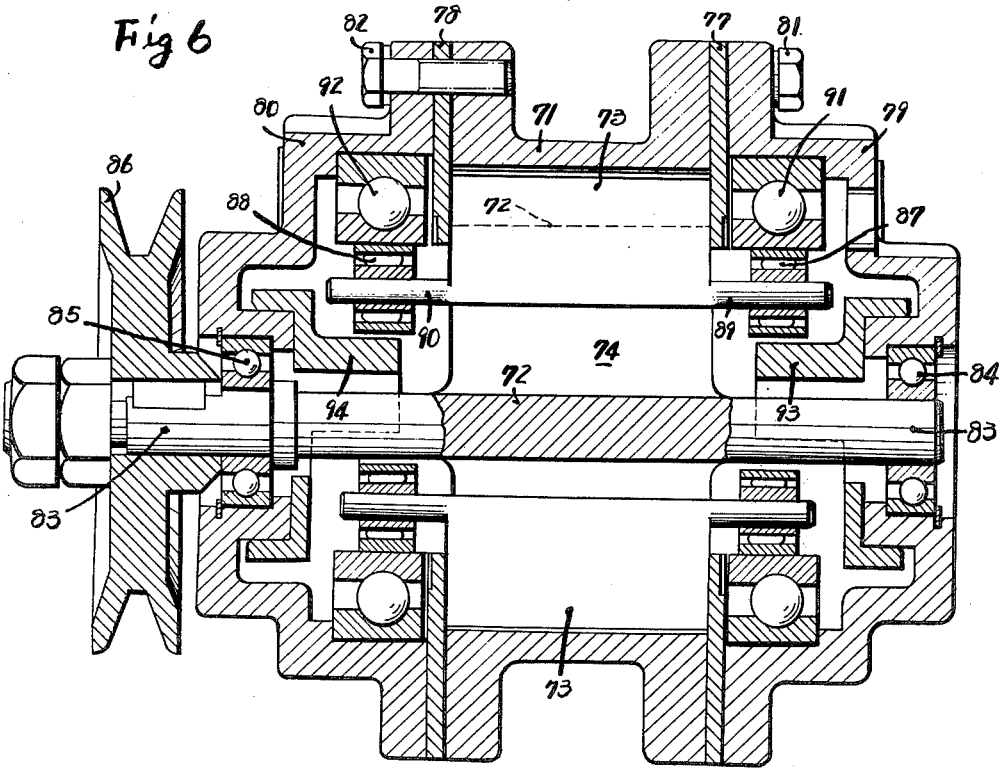
FIG. 6 is a section taken on the line VI—VI of FIG. 5.

The casing 71, as shown in FIG. 6, is cylindrical and has side covers 79 and 80 secured to the opposite open sides thereof by bolts 79 and 80 with side plates 77 and 78 interposed therebetween.

The rotor 72, as shown in FIG. 6, has a shaft 83 integral therewith rotatably mounted in bearing 84 and 85 in the side covers 79 and 80.

Therefore, said rotor 72 will rotate in an eccentric position in the casing 41. The rotor 72 has a driving pulley 86 fixed to one end thereof.

As shown in FIG. 6, the vanes 73 loosely fitted in the radial slots 74 in the rotor 72 have rolling members 87 and 88 on the opposite sides of the inner edges thereof. The rolling members 87 and 88 are constituted as by microbearings and mounted on shafts 89 and 90 projecting from the vanes 73.

Rotatable rail members 91 and 92 associated with said rolling members 87 and 88 are installed in the side covers 79 and 80. The rotatable rail members 91 and 92 are constituted by ball bearings, needle roller bearings or the like, having their outer races fixed to the side covers 79 and 80 and their inner races rendered free to rotate, the inner surfaces of said inner races supporting the rolling members 87 and 88 of the aforesaid vanes 73.

The guiding and supporting surfaces of the rotatable rail members 91 and 92 are of circular form concentric with and similar to the inner surface of the casing 71.

In addition, in FIG. 6, the numeral 93 and 94 designate auxiliary guide members which prevent the vanes 73 from falling down during stoppage of the pump and which, during operation of the pump, will be in non-interferring relation to the rolling members 87 and 88 of the vanes 73.

The operations of the pump is effected by rotating the rotor 72 through the driving pulley 86. Upon rotation of the rotor 72, the vanes 73 extend outwardly in the interior of the casing 71 by the action of centrifugal force. In this case, the rolling members 87 and 88 are in contact with the inner surfaces of the rotatable rail members 91 and 92 installed in the side covers 79 and 80, the further outward extension of the outer edges of the vanes 73 is suppressed, providing a slight clearance between said outer edges and the inner surfaces of the casing 71, thus assuring non-contact rotation of the vanes 73. The rotatable rail members 91 and 92 are more or less rotated by a contact pressure thereon exerted by the rolling members 87 and 88 which is obtained as fairly great load value as a result of the centrifugal force on the vanes. Thus, the rubbing wear of and the generation of heat in the rolling members are decreased. Since such vane 73 executes eccentric rotation, in the case of using a plurality of vanes 73 it is unavoidable for the respective rolling members 87 and 88 of the vanes 73 to have different peripheral speeds, but such differences in peripheral speed are accommodated to a large extent by the rotation of the rotatable rail members 87 and 88 around their own axes. Thus, the rotative loads and the generation of heat incident thereto are greatly decreased.

Since the third embodiments is as described above, it is possible to minimize the wear of and the generation of heat in the elements constituting the vane pump and greatly improve the performance and useful life of the vane pump.

In addition, the second and third embodiments of the invention have been described without regard to the strength of the shaft portions on the opposite sides of a vane on which rolling members are mounted, but when the shaft strengh becomes a problem, the following measures may be taken.

Since the vane is formed of a substantially thin rectangular plate, it is disadvantageous in point of manufacturing cost to form shaft portions integral therewith.

Figure 7:
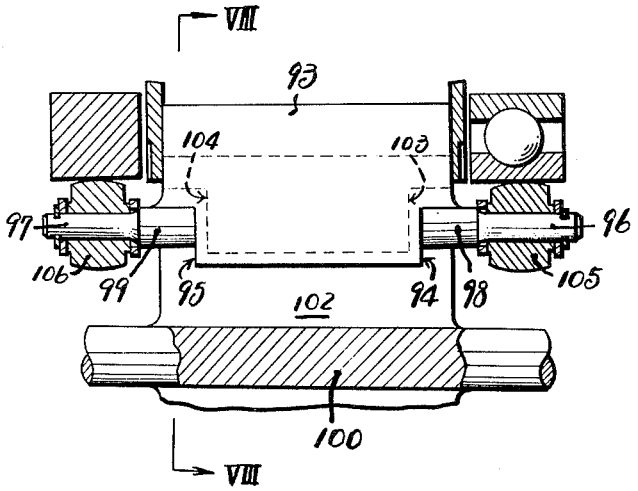
FIG. 7 is a front view showing an improved construction incorporated in the vanes shown in the second and third embodiments.
Figure 8:
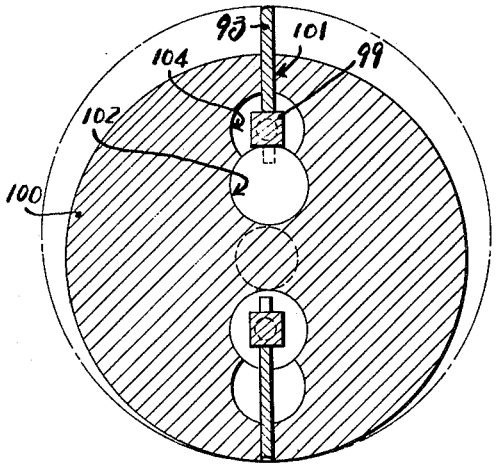
FIG. 8 is a section taken on the line VIII—VIII of FIG. 7.

Accordingly, as shown in FIGS. 7 and 8, the opposite sides of the inner edge of a vane 93 are provided with notches 94 and 95 in which blocks 98 and 99 having shafts 96 and 97 are then fixed as by welding. In the case of such vane construction, the block 98 would interfere with the mounting of the vane 93 in a radial slot 101 in a rotor 100.

Accordingly, the bottom portion of the radial slot 101 in the rotor 100 is provided with a throughgoing hole 102, as shown in FIG. 8, and the opposite sides of the rotor 100 are provided with recesses 103 and 104 which allow radial movement of the blocks 98 and 99. Since rolling members 105 and 106 are mounted on the shafts 96 and 97 before the vane is assembled into the rotor 100, the aforesaid throughgoing hole 102 must be large enough to allow passage of the rolling members 105 and 106 therethrough, and the vane 93 is inserted into the radial slot 101 laterally of the rotor 100. In FIG. 7, the right-hand half corresponds to the second embodiment and the left-hand half corresponds to the third embodiment.

Figure 9:
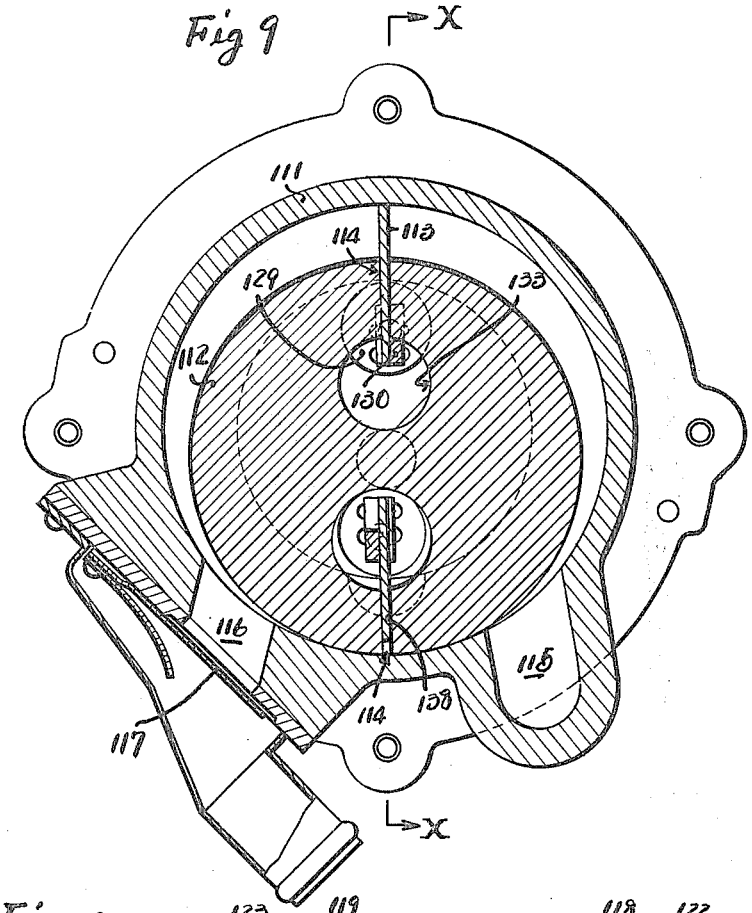
FIG. 9 is a longitudinal section of a fourth embodiment.

In FIG. 9 showing a fourth embodiment of the invention, the numeral 111 designates a pump casing; 112, a rotor eccentrically in the casing; 114, a vane loosely fitted in a radial slot 114 in the rotor; 115, a suction port; 116, a delivery port; and the numeral 117 designates a check valve provided on the delivery port.

Figure 10:
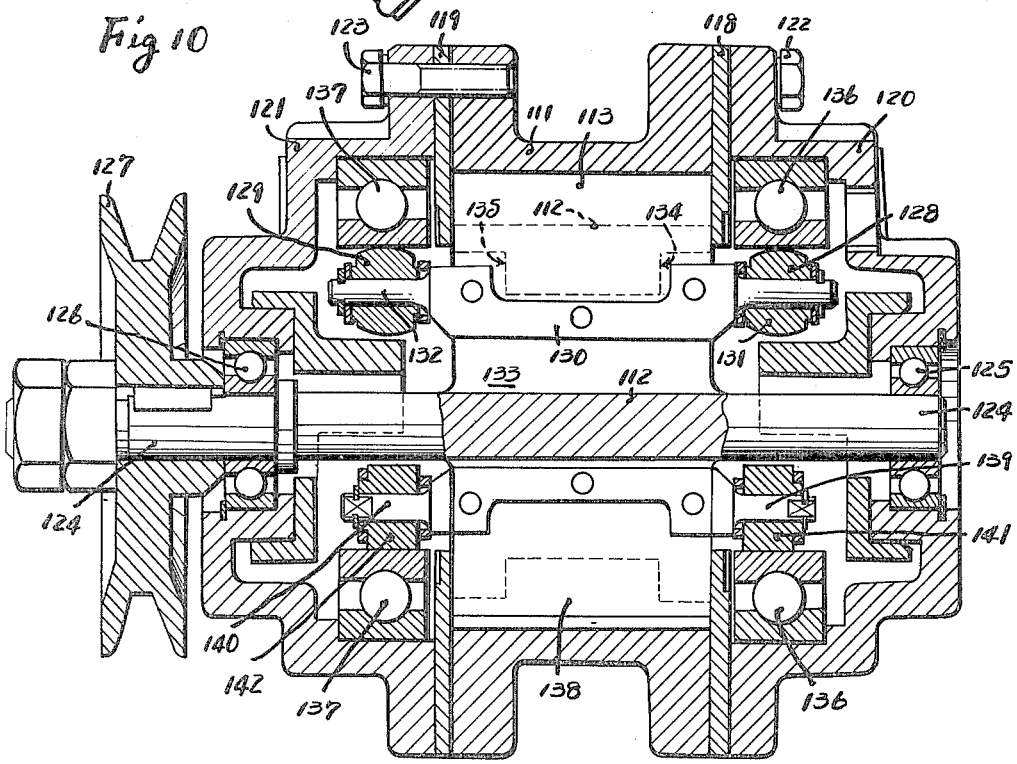
FIG. 10 is a section taken on the line X—X of FIG. 9.

The casing 111, as shown in FIG. 10, is cylindrical and has side covers 120 and 121 secured to the opposite sides thereof by bolts 122 and 123 with side plates 118 and 119 interposed therebetween.

The rotor 112, as shown in FIG. 10, has a shaft 124 integral therewith mounted in bearings 125 and 126 in the side covers 120 and 121, so that it is rotatable in an eccentric position in the casing 111. In addition, the shaft 124 has a driving pulley 127 secured to one end thereof. Thus, the driving of the rotor 112 is effected by said driving pulley.

As shown in FIG. 10, the vanes 113 loosely fitted in the radial slots 114 in the rotor 112 have rolling members 128 and 129 on the opposite sides of the inner edges thereof. The rolling members 128 and 129 are constituted by such members as microbearing and mounted on shafts 131 and 132 projecting from the opposite sides of base plates 130 riveted to the inner edges of the vanes 113.

When the vanes 113 are to be assembled into the rotor 112, the base plates 130 are riveted to the inner edges of the vanes 130 in advance, and the rolling members 128 and 129 are mounted on the shafts 131 and 132 on the opposited sides of the base plates 130, and in this condition the vanes are assembled. For this reason, the bottom portions of the radial slots 114 in the rotor 112 are provided with throughgoing holes 133 large enough to allow passage of the rolling members 128 and 129, as shown in FIG. 9, and the opposite sides of the rotor 112 are provided with recesses 134 and 135 to allow radial movement of the base plates 130 along with the vanes 113. With this arrangement, it is possible to insert vanes 113 into the radial slots 114 axially thereof.

Rotatable rail members 136 and 137 associated with said rolling members 128 and 129 are secured to the side covers 120 and 121, as shown in FIG. 10.

The rotatable rail members 136 and 137 are constituted substantially by ball bearings or needle roller bearings, the outer races being fixed to the side cover 120 and 121, the inner races supporting said rolling members 128 and 129 on their inner surfaces. The inner surfaces of the rotatable rail members 136 and 137 are of circular form concentric with and similar to the inner surface of the casing 111.

The rotatable rail members 136 and 137 may be positively rotated by utilizing the rotation of the rotor 112 or the vanes 113. To this end, rotation transmitting members are used. In the case of utilizing the rotation of the rotor 112, since the rotor 112 rotates in an eccentric position with respect to the rotatable rail members 136 and 137, it is possible to use rotation transmitting means which will allow such eccentric rotation. Alternatively, it is also possible to form portion of the rotatable rail members 136 and 137 with internal gear meshing with external gears formed on portions of the rotor 112 or its shaft, thereby transmitting rotation. On the other hand, there are various types which utilize the rotation of the vanes. Thus, as shown in the lower half of FIG. 10, friction rolls 141 and 142 formed of a material having a high coefficient of friction, e.g. phenol resin or polymide resin, are non-rotatably fixed to shafts 139 and 140 on the opposite sides of at least one vane 138 of the plurality of vanes 113 installed in the rotor 112.

In FIGS. 9 and 10, the vane 138 is used for the purpose of rotating the rotatable rail members 136 and 137, but it dose not perform the function of a "vane" for a vane pump. That is why the check valve 117 is installed on the delivery port 116, as shown in FIG. 9. Thus, if the member of vanes is increased, the check valve 117 becomes unnecessary.

With the fourth embodiment of the invention constructed in the manner described above, when the rotor 112 is rotated by a suitable driving device through the driving pulley 127, the vanes 113 and 138 are rotated along with the rotor 112 and extend outwardly by the action of centrifugal force. As a result, the rotatable member 128 and 129 and friction rolls 141 and 142 on the opposite sides of the vanes 113 and 138 contact the inner surfaces of the rotatable rail members 137 and 137.

Therefore, the further extension of the vane 113 is suppressed to provide a slight clearance between the outer edge of the vane and the inner surface of the casing 111, thus assuring non-contact rotation.

In this case, since the rotatable rail members 136 and 137 are rotated by the frictional force of the friction rolls 141 and 142 in the same direction as the rotor 112, the tendency for the rolling members 128 and 129 to rotate around their own axis can be decreased.

Figure 11:
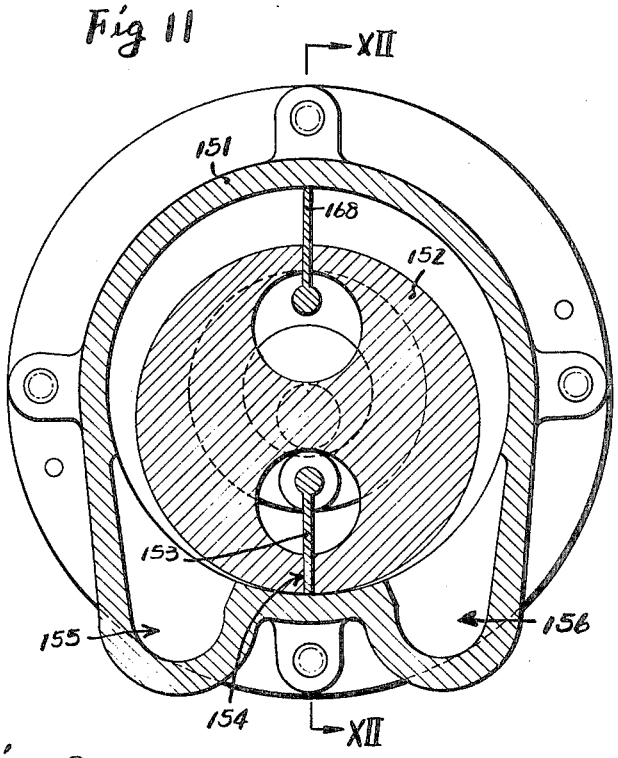
FIG. 11 is a longitudinal section of a fifth embodiment.

In FIG. 11 showing a fifth embodiment of the invention, the numeral 151 designates a pump casing, 152, a rotor eccentrically disposed in the casing; 153, a vane loosely fitted in a radial slot 154 in the rotor; 155, a suction port; and the numeral 156 designates a delivery port.

Figure 12:
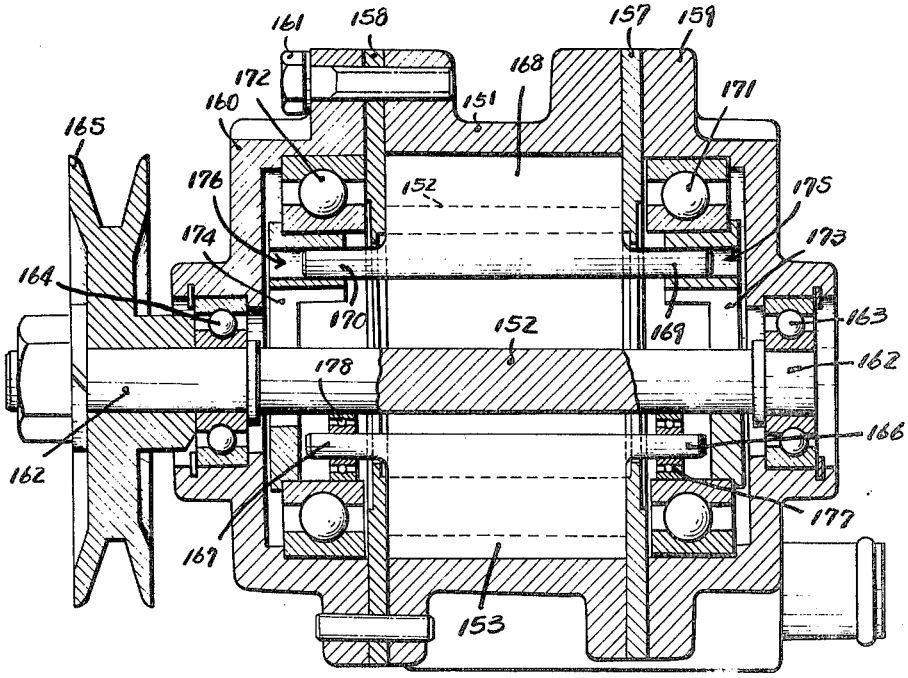
FIG. 12 is a section taken on the line XII—XII of FIG. 11.

The casing 151, as shown in FIG. 12, is cylindrical and has side covers 159 and 160 secured to the opposite sides thereof by bolts 161 with side plates 157 and 158 interposed therebetween.

The rotor 152, as shown in FIG. 12, has shaft 162 integral therewith supported in bearings 163 and 164 in the side covers 159 and 160. Thereby, the rotor will rotate in an eccentric position in the casing 151. In addition, a driving pulley 165 is secured to one end of the shaft 162 of the rotor 152.

The driving of the rotor 152 is effected through said pulley 165.

As shown in FIG. 12, the vanes 153 loosely fitted in the radial slots 154 in the rotor 152 have shaft portions 166 and 167 on the opposite sides of the inner edges thereof. At least one vane 168 of the vanes 153 installed in the rotor 152 has shaft portions 169 and 170 connected to the rotatable rail members 171 and 172 through connector rings 173 and 174. The rotatable members 171 and 172 are concentric with the casing 151, and the connector rings 173 and 174 are force-fitted in the rotatable rail members 171 and 172. The connector rings 173 and 174 are bored with small holes 175 and 176, in which the shaft portions 169 on the opposite sides of the vane 168 are inserted. Therefore, upon rotation of the rotor 152, the vane 168 is rotated around the axis of the casing 151.

The outer edge of the vane 168 is opposed to the inner surface of the casing 151 with a slight clearance therebetween, whereby the vane 168 execute a pumping action in the same way as the other vane 153.

In addition, mounted on the shaft portions 166 and 167 on the opposite side of the other vane 153 are rolling members 177 and 178 such as microbearings, opposed to the inner surfaces of the rotatable rail members 171 and 172.

With the fifth embodiment of the invention constructed in the manner described above, when rotation is imparted to the rotor 152, the vanes 153 and 168 rotate within the casing 151.

Thereby, the rotatable rail members 171 and 172 can be rotated in the same direction as the vane 163 through the vane 168 and the connector rings 173 and 174. In this case, the vane 168 joined to the connector rings 173 and 174 is rotated describing a circle concentric with the casing 151, so that non-contact rotation of the vane 168 can be effected with a slight clearance maintained between the outer edge of the vane 168 and the inner surface of the casing 151. The operative relation between the rotor 152 and the vane 168 is such that the rotation of the rotor 152 is transmitted to the vane 168 through the lateral surface of the radial slot 154 and during rotation the vane 168 slides in the radial slot 154. Since all the vanes loosely fitted in the rotor 152 are rotated by the rotor 152, they have the same angular speed. However, since the vanes 153 and 168 are moved radially of the rotor 152, there is a difference between the center distances between the shaft portions 166, 167, 169, 170 and the rotor 152 so that there is a difference in the peripheral speeds of the vanes 153 and 168 depending upon the positions of the shaft portions 166, 167, 169 and 170. This means that the rotative speed of the rotatable rail members 171 and 172 is gradually and periodically changed so that there is a difference in relative peripheral speed between the rotatable rail members 171 and 172 and the rolling members 177 and 178 which are in contact with said rotatable rail members. Since the rolling members 177 and 178 are rotatable around their own axes, said relative peripheral speed difference can be accommodated by the rotation of the rolling members 177 and 178 around their own axes, so that wear and the generation of heat can be prevented.

While the above example has been described by taking as an example a pump having two vanes, it is clear that the present invention is applicable to pumps having more than two vanes.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. A non-contact type vane pump comprising a pump casing, said pump casing including a casing member, side wall members secured to the opposite open sides of said casing member, side plate members interposed at the upper ends thereof between said side wall members and said casing with the lower ends thereof being inwardly spaced from the side wall members forming an area therebetween, and bolt means securing said side walls members and said side plate members to said casing member in locked, integral relationship, a rotor mounted for eccentric rotation within said casing, radial slots positioned in said rotor in opposed relation to one another, vane means fitted in said radial slots for advancing and retracting movement therein, rolling members projecting from the opposite end sides of said vane means, and rotatable rail members provided on the opposite sides of said casing and interposed in the area between the respective side wall members and side plate members to guide and support said rolling members of said vane means, the rolling members of at least one of said vane means being fixedly connected to a portion of the rotatable rail members whereby upon the rotation of the vane means or the rotor, the rotatable rail members will be rotated directly thereby, the guiding and supporting surfaces of said rotatable rail members having a circular configuration concentric with the inner surface of the casing.

2. A non-contact type vane pump in accordance with claim 1, wherein said shaft-like members are rolling members projecting from the opposite end sides of said vane means with at least one of said rolling members being fixedly connected with a portion of said rotatable rail members, and said rotatable rail members being directly rotated by the rotation of the vane means or the rotor when the pump is in operation.

* * * * *